United States Patent [19]

Payne et al.

[11] Patent Number: 4,608,950

[45] Date of Patent: Sep. 2, 1986

[54] MACHINE COVER

[75] Inventors: Derick B. Payne; Kenneth Osborne, both of Peterborough, England

[73] Assignee: Perkins Engines Group Limited, London, England

[21] Appl. No.: 682,048

[22] PCT Filed: Apr. 19, 1984

[86] PCT No.: PCT/GB84/00134

§ 371 Date: Dec. 7, 1984

§ 102(e) Date: Dec. 7, 1984

[87] PCT Pub. No.: WO84/04355

PCT Pub. Date: Nov. 8, 1984

[30] Foreign Application Priority Data

Apr. 23, 1983 [GB] United Kingdom ..... 8311084

[51] Int. Cl.[4] ..... F01M 9/10

[52] U.S. Cl. ..... 123/195 C; 123/90.38; 123/DIG. 6; 123/DIG. 7

[58] Field of Search ..... 123/DIG. 6, DIG. 7, 123/195 C, 90.38, 198 E

[56] References Cited

U.S. PATENT DOCUMENTS 2,452,232 10/1948 Fischer ..... 123/DIG. 7
2,454,612 11/1948 Paxman ..... 123/DIG. 6
4,198,947 4/1980 Rassey ..... 123/DIG. 7

FOREIGN PATENT DOCUMENTS 1035878 9/1953 France ..... 123/90.38
286994 3/1928 United Kingdom ..... 123/90.38
392282 5/1933 United Kingdom ..... 123/DIG. 7

*Primary Examiner*—Ira S. Lazarus
*Attorney, Agent, or Firm*—Robert L. Farris

[57] ABSTRACT

A machine cover comprising a main body 1 having two or more apertures 6 closed by interchangeable inserts 8,9, at least one of which incorporates an inlet duct 12 so that this inlet duct can be located in one of two or more different positions in the cover. A pair of interchangeable inserts for an adjacent pair of apertures may be formed in a single component 8 that is reversible end-to-end and which cooperates with both apertures 6 so that the filler duct 11 is aligned with either one while the other aperture is closed. One or more blanking inserts are provided to close each of the other apertures, one blanking component 9 being provided for each pair of adjacent apertures if desired. Alternatively, the insert 18 incorporating the filler duct 11 may be insertable in each aperture 16 in each of two or more different orientations in each of which the filler duct is located in a different position.

4 Claims, 5 Drawing Figures

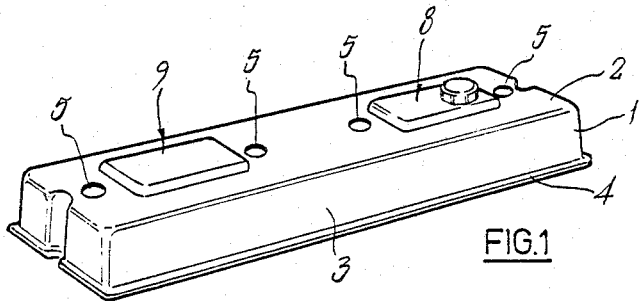
FIG.1
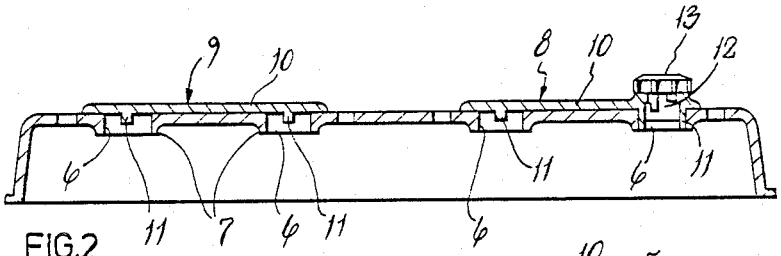
FIG.2
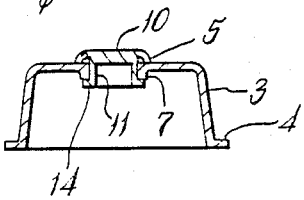
FIG.3
FIG.4
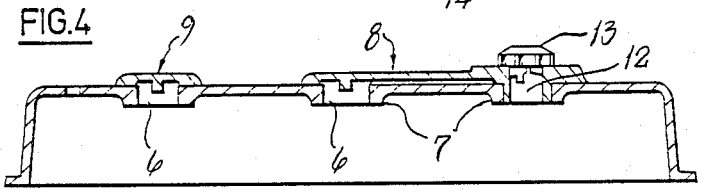
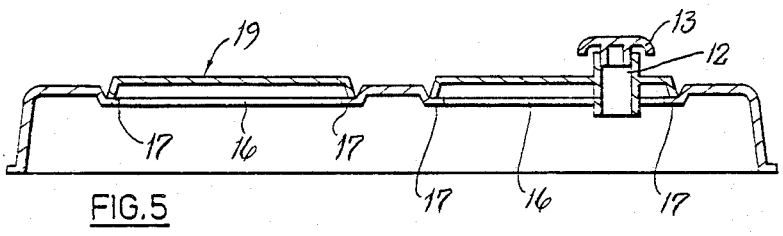
FIG.5

MACHINE COVER

TECHNICAL FIELD

This invention relates to a machine cover having an inlet duct which is located so as to be easily accessible for service use.

The rocker cover of an internal combustion engine is provided with an oil filler duct that is located so as to be easily accessible for topping-up the engine with oil. However, the best location for the filler duct can vary depending upon the installation in which it is used; for example, in one vehicle engine compartment the filler duct may be most easily accessible at one end of the engine whereas in another vehicle engine compartment in may be most easily accessible at the other end. In order to allow for this situation, engine manufacturer's usually provide a choice of different rocker covers with the filler duct integrally formed therein in a different location in each. However, doing this necessarily involves a cost penalty by increasing the number of different rocker covers that have to be manufactured and stocked.

DISCLOSURE OF THE INVENTION

An object of the present invention is to reduce or overcome this problem by providing a rocker cover that will serve all situations. This is achieved according to one aspect of the invention by providing a cover comprising a main body having two or more apertures closed by interchangeable closures, at least one of which incorporates an inlet duct so that this inlet duct can be located in one of two or more different positions in the cover.

A pair of interchangeable closures for an adjacent pair of apertures may be formed in a single component that is reversible end-to-end and which co-operates with both apertures so that the filler duct is aligned with either one whilst the other aperture is closed. If three or more apertures are equi-spaced along the length of the rocker cover the closure can co-operate with any pair of adjacent apertures so as to align the filler duct with any one of them. One or more closures are provided to close each of the other apertures, one closure being provided for each pair of adjacent apertures if desired.

Alternatively, according to another aspect of the invention, a machine cover comprises a main body having at least one aperture with which a closure incorporating a filler duct is engageable in each of two or more different orientations so that the filler duct can be located in each of two or more different positions. For example, the filler duct may be offset along the centre line of an elongate closure so that the closure can be reversed end-to-end in a corresponding elongate aperture to locate the filler duct in either of two positions along this centre line.

The invention will now be described by way of example with reference to the accompanying drawings in which;

DESCRIPTION OF THE DRAWINGS

FIG. 1 shows one embodiment of a diesel engine rocker cover according to the invention, FIG. 2 is a longitudinal section along the centre line of the rocker cover of FIG. 1, FIG. 3 is a section along the line S—S in FIG. 2, but showing an alternative method of attaching the closures to the rocker cover, FIG. 4 shows a modified form of the rocker cover of FIG. 1, and FIG. 5 shows another embodiment of a rocker cover according to the invention.

DISCLOSURE OF BEST MODE OF CARRYING OUT THE INVENTION

The illustrated rocker cover comprises a main metal body 1 having a top wall 2 with downwardly extending side walls 3 that terminate in a peripheral sealing flange 4. Bolt holes 5 are provided in the top wall 2 along the longitudinal centre line of the cover to allow the cover to be bolted in place on the cylinder head of an engine with the flange 4 in sealing engagement with the head.

Four circular apertures 6 are formed at equi-spaced points along the centre line of the top wall 2 and each is formed with a downwardly projecting collar 7.

Two plastic closures 8, 9 are provided to co-operate with the apertures 6 in the rocker cover, each comprising a flat plate 10 with two projections 11 on its underside that are adapted for insertion into an adjacent pair of apertures 6. In one closure 8, one of the projections 11 is cylindrical and forms the lower end of a duct 12 that extends through the plate 10 and is provided with a cap 13 at its upper end. This duct 12 serves as an oil filler duct. The other projections 11 each comprise a tramsverse rib that co-operates with the sides of the respective aperture 6 in which it is inserted. Thus, the oil filler duct 12 can be engaged in any one of the apertures 6, thereby giving four possible positions for the oil filler. As shown in FIG. 1, the oil filler is fitted in the extreme right-hand position. If the closure 8 is reversed end-to-end before insertion in the same pair of apertures, the oil filler will assume the inner right-hand position. Alternatively, if the two closures 8, 9 are interchanged, the oil filler can be fitted in either of the left-hand positions. The closures 8, 9 are attached by adhesive to the cover 1, for example by adhesive between the periphery of each closure and the cover.

Alternatively, the closures 8, 9 may be a snap fit with the cover 1, for example, as shown in FIG. 3, each projection 11 may be cylindrical and include an outwardly projecting lip 14 is provided around its lower end so as to engage with the lower edge of the collar 7 surrounding the apertures 6. Additionally, the outer periphery of the plate 10 may be formed as a downwardly flared resilient flange 15 that co-operates with the upper wall 2 of the cover to hold the lip 14 and collar 7 in engagement.

FIGS. 1 and 2 illustrate a rocker cover that provides four different positions for the oil filler duct 12. FIG. 4 illustrates an alternative rocker cover that provides three different positions for the oil filler duct 12, the cover 1 being provided with three equi-spaced apertures 6 and a closure 8, similar to that of FIG. 1, being inserted in either pair of adjacent apertures with the duct 12 located at either end or in the central aperture 6. A plastics closure member 9 is provided to close the one aperture 6 not engaged by the insert 8.

An alternative embodiment of the invention is illustrated in FIG. 5 in which two substantially rectangular apertures 16 are formed in the top wall 2 of the rocker cover along the centre line. A peripheral flange 17 around each aperture extends downwards from the top wall and inwards in the plane of the aperture to form a recessed seat for a closure.

Each closure is made of plastics and is rectangular in form so as to be a close fit with the flange 17. Adhesive is used to secure each closure 18, 19 in place over its aperture 16.

One of the closures 18 incorporates an oil filler duct 12 that is closed by a removable cap 13. The filler duct 12 is offset to one side of the centre of the closure along the centre line of the top wall 2. It will be appreciated that this closure 18 can be fitted over an aperture 16 with the filler duct 12 positioned at either end of the aperture. Also, the closure 18 can be fitted over either of the apertures 16 so that the filler duct 11 can assume any one of four possible positions along the centre line.

The other closure 19 is formed as a simple blanking component to close the aperture not used for the oil filler duct.

It will be appreciated that the apertures 16 and closures 18,19 can have any elongate shape symmetrical about an axis transverse to the centre line of the cover so that each closure is reversible end-to-end therein and the filler duct 11 can be located either side of the transverse axis.

In yet another embodiment of the invention only one aperture 16 and the one closure 18 may be provided so that the filler duct 11 can assume only the two positions along the centre line of the one aperture.

We claim:

1. A machine cover comprising a main body having structure defining two apertures located adjacent one another, and a closure component which incorporates an inlet duct and which is adapted to cooperate with said structure so that the inlet duct is aligned with either aperture whilst closing the other aperture, the closure component being reversible end-to-end between two positions in which the inlet duct cooperates within a respective aperture.

2. A cover as claimed in claim 1 in which the main body has structure defining four apertures two of which are engaged by said closure component and the other two of which lie adjacent one another and are closed by another closure component.

3. A cover as claimed in claim 1 in which the inlet duct comprises a cylindrical member that engages said aperture to retain the closure component in place.

4. A cover as claimed in claim 1 in which said closure component is secured by adhesive to the main body.

* * * * *